United States Patent [19]

Lyman et al.

[11] 4,423,534

[45] Jan. 3, 1984

[54] VACUUM CLEANER HANDLE LOCK

[75] Inventors: John B. Lyman, Bloomington; George A. Westergren, Lindwood Township, Anoka County, both of Minn.

[73] Assignee: Whirlpool Corporation, Benton Harbon, Mich.

[21] Appl. No.: 330,077

[22] Filed: Dec. 14, 1981

[51] Int. Cl.[3] ..... A47L 9/32
[52] U.S. Cl. ..... 15/410
[58] Field of Search ..... 15/354, 410, 333

[56] References Cited

U.S. PATENT DOCUMENTS 3,512,207 5/1970 Ettridge ..... 15/410 X
3,932,912 1/1976 Johnson ..... 15/410

FOREIGN PATENT DOCUMENTS 598972 3/1948 United Kingdom ..... 15/410

*Primary Examiner*—Chris K. Moore
*Attorney, Agent, or Firm*—Wood, Dalton, Phillips, Mason & Rowe

[57] ABSTRACT

A vacuum cleaner handle lock for releasably retaining the handle in a storage or transport position. The handle is connected to the vacuum cleaner nozzle by a connector defining a latch shoulder. The handle lock includes a mounting portion pivotally mounted to the nozzle, a shoulder portion defining a stop shoulder releasably engaging the latch shoulder of the handle connector, a spring portion biasing the handle lock into engagement with the latch shoulder, and a pedal portion for manipulation by the user to disengage the stop shoulder from the latch shoulder to release the handle when desired. The handle lock is formed as a onepiece element.

18 Claims, 5 Drawing Figures

FIG. 5
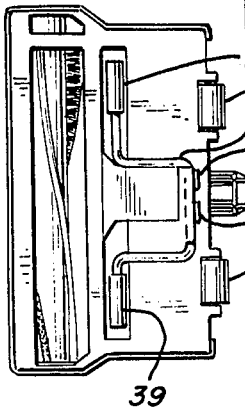
FIG. 1
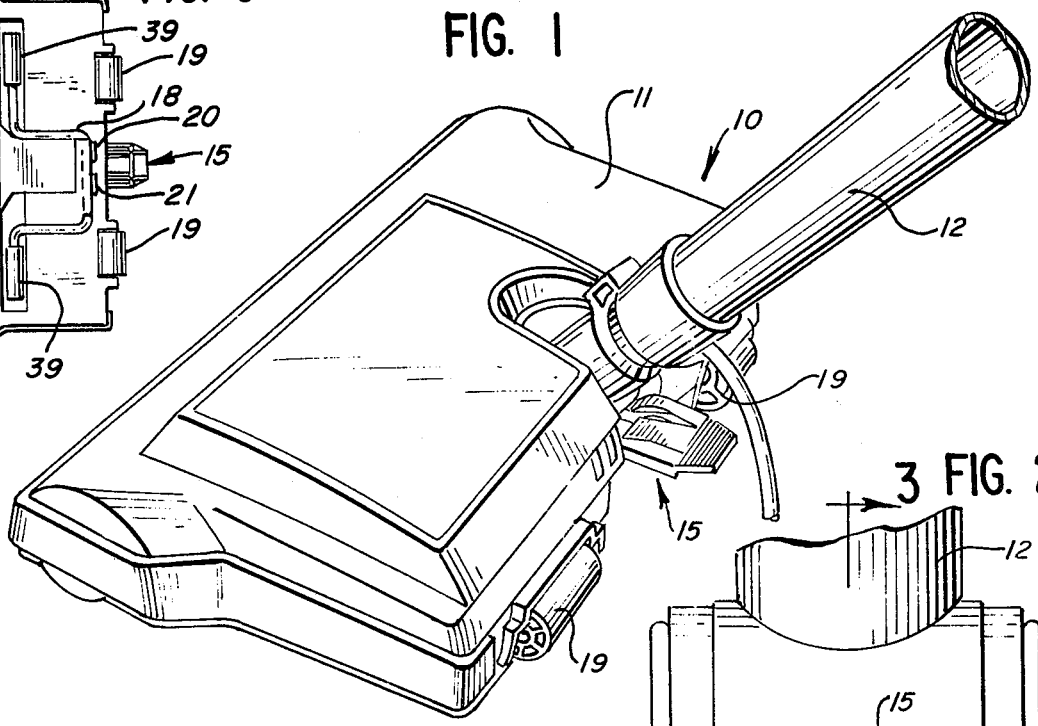
3 FIG. 2
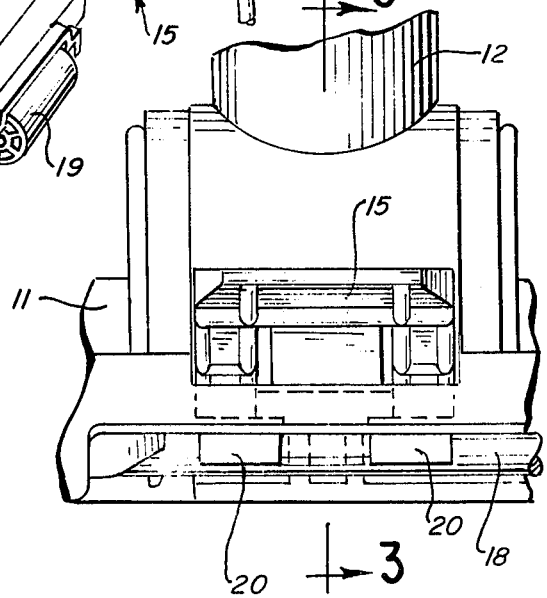
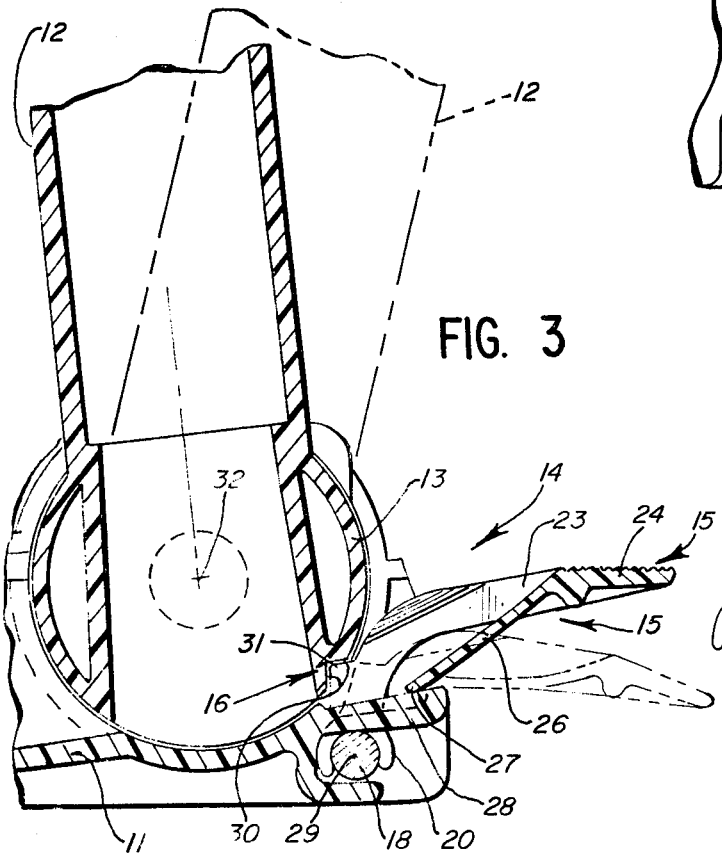
FIG. 3
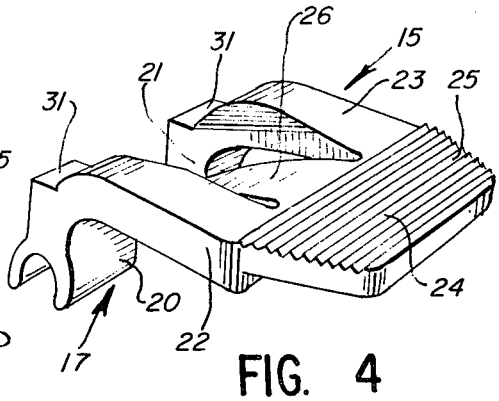
FIG. 4

VACUUM CLEANER HANDLE LOCK

BACKGROUND OF THE INVENTION

1. Field of the Invention

This invention relates to vacuum cleaner structures and in particular to means for releasably retaining the handle thereof in a storage and/or transport position.

2. Description of the Background Art

In U.S. Letters Pat. No. 3,512,207 of Ian G. Ettridge, a vacuum cleaner structure is shown to include a handle which is pivotally mounted to the nozzle and retained in a vertical carrying position by a spring-biased cam. A foot-operated pedal is provided to release the cam from engagement with the projections on the handle connector. Release of the cam from the first projection permits the handle to be moved downwardly to a first inclined position wherein the cam engages the second projection on the handle connector. Continued downward movement of the handle causes the cam to ride on the second projection and continue down to a horizontal position of the handle as desired.

Another vacuum cleaner structure is illustrated in U.S. Letters Pat. No. 2,039,861, of Noble H. Watts, wherein the handle is mounted between ears on the top of the nozzle with stop means being provided for the handle within the nozzle.

In U.S. Pat. No. 3,683,449 of Erwin E. Nordeen and U.S. Pat. No. 3,766,594 of George A. Westergren et al, each of which patents is owned by the assignee hereof, foot pedal means are provided for releasably holding structures in a vacuum cleaner.

Dale M. Friesen et al, disclose in U.S. Letters Pat. No. 3,870,491, which patent is also owned by the assignee hereof, a latching means including an integral spring portion.

SUMMARY OF THE INVENTION

The present invention comprehends an improved vacuum cleaner handle lock which is extremely simple and economical of construction.

More specifically, the invention comprehends the provision in a vacuum cleaner having a nozzle provided with a pivot element defining a pivot axis and the handle having a connector mounted to the nozzle to swing about a second axis parallel to the pivot axis to and from a storage position, of an improved handle locking means including means on the connector defining a latch shoulder and a one-piece handle lock having a mounting portion pivotally mounted to the element to pivot about the pivot axis, a shoulder portion defining a stop shoulder, and a spring portion defining means for biasing the handle lock to releasably engage the stop shoulder with the latch shoulder and thereby retain the handle releasably in the storage position.

In the illustrated embodiment, the mounting portion is defined by a pivot connector pivotally embracing the pivot element.

In the illustrated embodiment, the handle lock further includes a pedal portion adapted to be depressed by the user's foot to swing the stop shoulder away from the latch shoulder and thereby release the handle for movement from the storage position.

In the illustrated embodiment, the shoulder portion defining the stop shoulder is carried by the pivot connector.

More specifically, the mounting portion, in the illustrated embodiment, comprises a pair of C-shaped pivot connectors pivotally embracing the pivot element. The shoulder portion defines a pair of stop shoulders one each carried by the connectors, with the latch shoulder being engaged concurrently by each of the stop shoulders.

In the illustrated embodiment, the latch shoulder comprises a right angle corner surface.

In the illustrated embodiment, the spring portion comprises a leaf spring extending from the pedal portion to be disposed between the pivot connectors.

The latch shoulder effectively defines a camming means for urging the stop shoulder against the biasing action of the spring portion to disengage the stop shoulder from the latch shoulder as an incident of forceful urging of the handle from the storage position in the absence of depression of the pedal portion to release the handle.

In the illustrated embodiment, the pivot axis is defined by the wheel axle of the nozzle.

The handle lock is the retainer for the wheel axle on which it pivots.

In the illustrated embodiment, the handle lock defines a C-shaped configuration, with the shoulder portion being defined by the legs thereof and the manipulating pedal portion being defined by the bight thereof. In the illustrated embodiment, the spring portion extends from the bight portion intermediate the shoulder portion legs to form a generally E-shape as seen in a plan view of the handle lock with the bight portion at the left and extending vertically.

The manipulating portion, in the illustrated embodiment, is provided with an irregular engagement surface for improved facilitated manipulation of the handle lock.

Thus, the vacuum cleaner handle lock means of the present invention is extremely simple and economical of construction while yet providing an improved releasable means for retaining the handle in the storage and/or transport position. In this storage or transport position the handle is substantially upright and approximately at right angles to the approximately horizontally extending nozzle. The illustrated power driven brush vacuum cleaner attachment embodying the invention is most advantageously transported or carried when in such storage or transport position.

BRIEF DESCRIPTION OF THE DRAWING

Other features and advantages of the invention will be apparent from the following description taken in connection with the accompanying drawing wherein:

FIG. 1 is a fragmentary perspective view of a portion of a canister vacuum cleaner power driven brush attachment having a handle lock means embodying the invention;

FIG. 2 is a fragmentary rear elevation with a portion of the vacuum cleaner attachment illustrating the handle lock means in greater detail;

FIG. 3 is a fragmentary vertical section taken substantially along the line 3—3 of FIG. 2;

FIG. 4 is a perspective view of the one-piece handle lock embodying the invention; and FIG. 5 is a bottom plan view of the vacuum cleaner attachment of FIG. 1.

DESCRIPTION OF THE PREFERRED EMBODIMENT

In the illustrative embodiment of the invention as disclosed in the drawing, a vacuum cleaner generally designated 10 includes a nozzle 11 and a handle 12 pivotally connected to the nozzle by a connector 13. The connector 13 may be advantageously formed of a plastic material such as polyethylene or polypropylene. The handle is swingable from a storage position shown in full lines in FIG. 3, to an inclined disposition such as shown in broken lines in FIG. 3 and in full lines in FIG. 1, as during vacuum cleaning operation by the user. The present invention is concerned with an improved locking means for releasably retaining the handle in the storage position.

More specifically, the locking means generally designated 14 includes a handle lock generally designated 15, and means on the connector 13 generally designated 16 defining a latch shoulder for cooperation with the handle lock in releasably retaining the handle in the storage position shown in full lines in FIG. 3.

As seen in FIG. 4, the handle lock 15 comprises a one-piece element having a mounting portion generally designated 17 for mounting the handle lock to a pivot element 18 associated with the nozzle. In the illustrated embodiment, the pivot element 18 comprises the axle of the front wheels or rollers 39 of the nozzle. The front wheels or rollers 39 are shown in FIG. 5. The nozzle base 11*a* is recessed to receive the front wheels 39 and is formed to provide a rearwardly open groove to receive the bight portion of the axle 18.

In the illustrated embodiment, the mounting portion comprises a pair of C-shaped pivot connectors 20 and 21 each adapted to embrace a portion of the axle 18 for pivotally mounting the handle lock thereto and for retaining the axle on the nozzle. When the axle 18 is in its retained disposition, a portion of the nozzle 11*a* overlies a portion of the bight of axle 18 assisting handle lock connectors 20 and 21 in the retention of the axle on the nozzle. The C-shaped connectors extend arcuately over 180° and are snapped about the axle to provide a pivotal connection thereof to the axle.

As seen in FIG. 4, the handle lock 15 itself is generally C-shaped, with the legs of the C-shaped configuration being defined by axially spaced legs 22 and 23 carrying at their distal ends the C-shaped connector portions 20 and 21. The bight of the C-shaped configuration of the handle lock defines a pedal portion 24 which, as seen in FIG. 4, may have the upper surface thereof made irregular as by the provision of striations 25 to help prevent slippage between a foot and the pedal portion 24.

Projecting forwardly from the pedal portion 24 intermediate the legs 22 and 23 is a spring portion, or tongue, 26 which, as seen in FIG. 3, has a distal end 27 engaging a rearwardly projecting flange 28 on the rear wall of the base of nozzle 11. The spring portion 26 being intermediate and parallel to legs 22 and 23 results in a somewhat E-shape for the handle lock as seen from above. Spring tongue 26 biases the handle lock in a counterclockwise direction, as seen in FIG. 3, about the pivot axis 29 of axle 18. The handle lock 15 may advantageously be formed from a suitable plastic material such as Delrin brand acetal synthetic resin or Celcon brand acetal synthetic resin.

As further shown in FIG. 3, latch shoulder means 16 defines a right angle corner formed by surfaces 30 opening rearwardly and downwardly in connector 13. As best seen in FIG. 4, each of legs 22 and 23 of the handle lock is provided at its forward downturned portion with a shoulder portion defining a stop shoulder 31. The stop shoulders are complementary in configuration to the corner surfaces 30 and, thus, as seen in FIG. 3, are urged into the notch defined by the corner surfaces 30 by the action of spring 26 when the handle 12 is in the upright storage disposition. Thus, the stop shoulders effectively releasably retain the handle in the storage position.

However, when it is desired to release the handle from the storage position, the user need merely press downwardly on the pedal portion 24 with his foot so as to swing the stop shoulders 31 from the notch and thereby disengage the handle lock for repositioning of the handle as desired.

As seen in FIG. 3, handle 12 which contains the corner surfaces 30 may be swung in a clockwise direction about the axis 32 of the connector 13 against the spring-biased stop shoulders 31 by a forceful urging of the handle 12 from the upward storage position shown in full line to the broken line angled position. The shapes of the notch formed by the corner surfaces 30 and the cooperating complementary shape stop shoulders 31, the plastic materials used to form the connector 13 and the handle lock 15, and the cooperation of the connector 13 and the handle lock 15 are such that forcibly moving the connector as by stepping on the nozzle and moving the handle 12 without releasing the lock will override the lock without damage to the connector or lock. As a result, the handle lock may be swung to the released disposition shown in broken lines in FIG. 3, thus providing a fail-safe operation, avoiding damage to the handle locking components.

The handle lock is spring-biased by spring portion 26 suitably to retain the handle 12 in the storage position without manipulation thereof solely as an incident of the handle being swung by the user to the storage position.

The handle lock may be economically manufactured as a molded element formed of a suitable synthetic resin such as Delrin brand or Celcon brand acetal synthetic resin.

The foregoing disclosure of specific embodiments is illustrative of the broad inventive concepts comprehended by the invention.

Having described the invention, the embodiments of the invention in which an exclusive property or privilege is claimed are defined as follows:

1. In a vacuum cleaner having a nozzle provided with a pivot element defining a pivot axis, and a handle having a connector mounted to said nozzle to swing about a second axis parallel to said pivot axis to and from a storage position, the improvement comprising:

means on the connector defining a latch shoulder; and a one-piece handle lock having a mounting portion pivotally mounted to said element to pivot about said pivot axis, a shoulder portion defining a stop shoulder, and a spring portion defining means for biasing the handle lock to releasably engage said stop shoulder with said latch shoulder and thereby retain said handle releasably in said storage position.

2. The vacuum cleaner structure of claim 1 wherein said mounting portion comprises a pivot connector pivotally embracing said pivot element.

3. The vacuum cleaner structure of claim 1 wherein said handle lock further includes a pedal portion adapted to be depressed by the user's foot to swing said stop shoulder away from said latch shoulder and thereby release said handle for movement from said storage position.

4. The vacuum cleaner structure of claim 1 wherein said mounting portion comprises a pivot connector pivotally embracing said pivot element, said shoulder portion being carried by said pivot connector.

5. The vacuum cleaner structure of claim 1 wherein said mounting portion comprises a pair of C-shaped pivot connectors pivotally embracing said pivot element.

6. The vacuum cleaner structure of claim 1 wherein said mounting portion comprises a pair of C-shaped pivot connectors pivotally embracing said pivot element, said shoulder portion defining a pair of stop shoulders one each carried by said connectors, said latch shoulder being engaged concurrently by each of said stop shoulders.

7. The vacuum cleaner structure of claim 1 wherein said latch shoulder comprises a right angle corner surface and said stop shoulder being complementary thereto.

8. The vacuum cleaner structure of claim 1 wherein said mounting portion comprises a pair of axially spaced pivot connectors and said spring portion comprises a leaf spring disposed between said pivot connectors.

9. The vacuum cleaner structure of claim 1 wherein said handle lock further includes a pedal portion adapted to be depressed by the user's foot to swing said stop shoulder away from said latch shoulder and thereby release said handle for movement from said storage position, said latch shoulder further defining camming means for urging the stop shoulder against the biasing action of said spring portion to disengage the stop shoulder from the latch shoulder as an incident of forceful urging of the handle from the storage position in the absence of depression of the pedal portion to release the handle.

10. In a vacuum cleaner having a nozzle provided with a wheel axle defining a pivot axis, a handle having a connector pivotally mounted to said nozzle to swing about a second axis parallel to said axle pivot axis to and from a storage position, the improvement comprising:

means on the connector defining a latching notch; and a one-piece handle lock having a mounting portion pivotally mounted to said axle to pivot about said pivot axis, a pair of spaced shoulder portions defining a pair of stop shoulders, a spring portion between said shoulder portions engaging said nozzle for biasing the handle lock to releasably engage said stop shoulders with said connector in said latching notch and thereby retain said handle releasably in said storage position, and a manipulating portion adapted to be engaged by a user for swinging the shoulder portions away from engagement with said connector against the biasing action of said spring portion, thereby to release said handle for movement away from said storage position.

11. The vacuum cleaner structure of claim 10 wherein said handle lock defines a C-shaped configuration, said shoulder portions being defined by the legs of the C-shaped configuration and said manipulating portion being defined by the bight of the C-shaped configuration.

12. The vacuum cleaner structure of claim 10 wherein said handle lock defines a C-shaped configuration, said shoulder portions being defined by the legs of the C-shaped configuration and said manipulating portion being defined by the bight of the C-shaped configuration, said spring portion extending from said bight portion intermediate said shoulder portions.

13. The vacuum cleaner structure of claim 10 wherein said handle lock defines a C-shaped configuration, said shoulder portions being defined by the legs of the C-shaped configuration and said manipulating portion being defined by the bight of the C-shaped configuration, said spring portion extending from said bight portion intermediate said shoulder portions, and comprising a resilient tongue having a distal end engaging a portion of said nozzle.

14. The vacuum cleaner structure of claim 10 wherein said manipulating portion is provided with an irregular engagement surface.

15. In a vacuum cleaner structure having a nozzle provided with a pivot element defining a pivot axis, and a handle having a connector mounted to said nozzle to swing about a second axis parallel to said pivot axis to and from a storage position, the improvement comprising:

means on the connector defining a latch shoulder; and a handle lock having a mounting portion pivotally mounted to said element to pivot about said pivot axis, a shoulder portion defining a stop shoulder, and a spring portion defining means for biasing the handle lock to releasably engage said stop shoulder with said latch shoulder and thereby retain said handle releasably in said storage position, said mounting portion comprising a pair of axially spaced pivot connectors and said spring portion comprising a leaf spring disposed between said pivot connectors.

16. The vacuum cleaner structure of claim 15 wherein said pivot element comprises an axle for a wheel member to support said structure and said handle lock retains said axle with respect to said structure.

17. The vacuum cleaner structure of claim 15 wherein said handle lock comprises means arranged to be released by forcibly moving said handle relative to said nozzle while holding said nozzle, causing said stop shoulder and shoulder portion to be disengaged without damage to said structure, providing fail-safe operation for said handle lock.

18. The vacuum cleaner structure of claim 15 wherein said pivot connectors are joined by a bight portion, and said spring portion extends from said bight portion parallel to said pivot connectors to provide an approximate E-shape for said handle lock.

* * * * *